US005301457A

United States Patent [19]

Seely

[11] Patent Number: 5,301,457

[45] Date of Patent: Apr. 12, 1994

[54] CHAIR WITH INSECT REPELLANT AIR JETS

[76] Inventor: James R. Seely, 35 Anvil Dr., Avon, Conn. 06001

[21] Appl. No.: 20,660

[22] Filed: Feb. 22, 1993

[51] Int. Cl.[5] ..... A01M 1/20

[52] U.S. Cl. ..... 43/132.1; 297/180.14; 297/DIG. 3; 454/189; 454/907; 5/423

[58] Field of Search ..... 128/200.27, 200.28; 4/541.5; 454/188, 189, DIG. 907; 5/284, 423, 658, 469; 297/DIG. 3, 180.1, 180.11, 180.12, 180.13, 180.14, 180.15; 43/132.1, 124

[56] References Cited

U.S. PATENT DOCUMENTS

| | | | |
|---|---|---|---|
| 580,284 | 4/1897 | Krieg, Sr. . | |
| 969,857 | 9/1910 | Grove . | |
| 1,118,353 | 11/1914 | Jurkowski . | |
| 1,505,914 | 8/1924 | Witteborg . | |
| 2,097,751 | 11/1937 | Baltich | 5/658 |
| 2,817,281 | 12/1957 | Schwan et al. . | |
| 2,912,832 | 11/1959 | Clark | 454/907 |
| 3,151,929 | 10/1964 | Potapenko . | |
| 3,625,434 | 12/1971 | Kitover | 297/180 |
| 3,628,829 | 12/1971 | Heilig | 297/180 |
| 4,141,585 | 2/1979 | Blackman | 297/180 |
| 4,548,357 | 10/1985 | Schmidt | 297/180 |
| 4,765,542 | 8/1988 | Carlson . | |
| 4,961,535 | 10/1990 | Skibik | 297/180 |
| 4,981,324 | 1/1991 | Law | 297/180 |
| 5,000,384 | 3/1991 | Arnold . | |

FOREIGN PATENT DOCUMENTS

| | | | |
|---|---|---|---|
| 0491145 | 10/1991 | European Pat. Off. | 5/284 |
| 1257562 | 2/1961 | France | 454/189 |
| 1567176 | 5/1990 | U.S.S.R. | 297/180 |

*Primary Examiner*—Paula A. Bradley
*Assistant Examiner*—James Miner
*Attorney, Agent, or Firm*—Chilton, Alix & Van Kirk

[57] ABSTRACT

A chaise lounge and upright chair, representing two embodiments of the invention, each having a frame with tubular components forming a primary air plenum having a predetermined orientation with respect to an occupant in a normal position sitting on the upright chair or lying on the chaise lounge. A blower unit is connected to the air plenum and the tubular components have a plurality of air nozzles with axes pointing in specific directions to produce air stream barriers which cover and bathe the occupant of the chair. Opposed rows of air nozzles, on opposite sides of the occupant, have axes pointing outwardly from the chair and laterally inwardly to intersect at approximately a vertical centerline plane of the chair to cover the occupant between the two rows of nozzles. Additional nozzles protect other parts of the occupant so that in both embodiments, air stream barriers are produced which protect the occupant from head to feet.

21 Claims, 5 Drawing Sheets

CHAIR WITH INSECT REPELLANT AIR JETS

The present invention relates generally to outdoor chairs and relates more particularly to outdoor chairs having a new and improved arrangement of air nozzles for producing air jets for repelling mosquitoes and other flying insects.

A principal object of the present invention is to provide a new and improved outdoor chair having a special arrangement of air nozzles for producing air stream barriers for protecting an occupant of the chair against mosquitoes and other flying insects.

Another object of the present invention is to provide a new and improved outdoor chair having a tubular frame with air nozzles specially arranged around the frame to produce a barrier of turbulent air for protecting an occupant, including, for example, the head, neck, forearms, lower legs and ankles of the occupant, against mosquitoes and other flying insects. In accordance with the present invention, the air nozzles are arranged to produce air stream barriers which lightly bathe certain areas of the occupant so that the occupant is free to use the chair in a normal manner without risk of exposure to mosquitoes and other flying insects.

Another object of the present invention is to provide a new and improved upright chair embodying the present invention, having an arrangement of air nozzles for producing air stream barriers which protect the normally exposed areas of the occupant against mosquitoes, including the head, neck, forearms, lower legs and ankles of the occupant.

Another object of the present invention is to provide a new and improved chaise lounge embodying the present invention and a new and improved upright chair embodying the present invention, each having an arrangement of air nozzles for producing air stream barriers which protect substantially the entire occupant against mosquitoes.

Other objects will be in part obvious and in part pointed out more in detail hereinafter.

A better understanding of the invention will be obtained from the following detailed description and accompanying drawings of illustrative applications of the invention.

DESCRIPTION OF PREFERRED EMBODIMENTS

Figure 2:
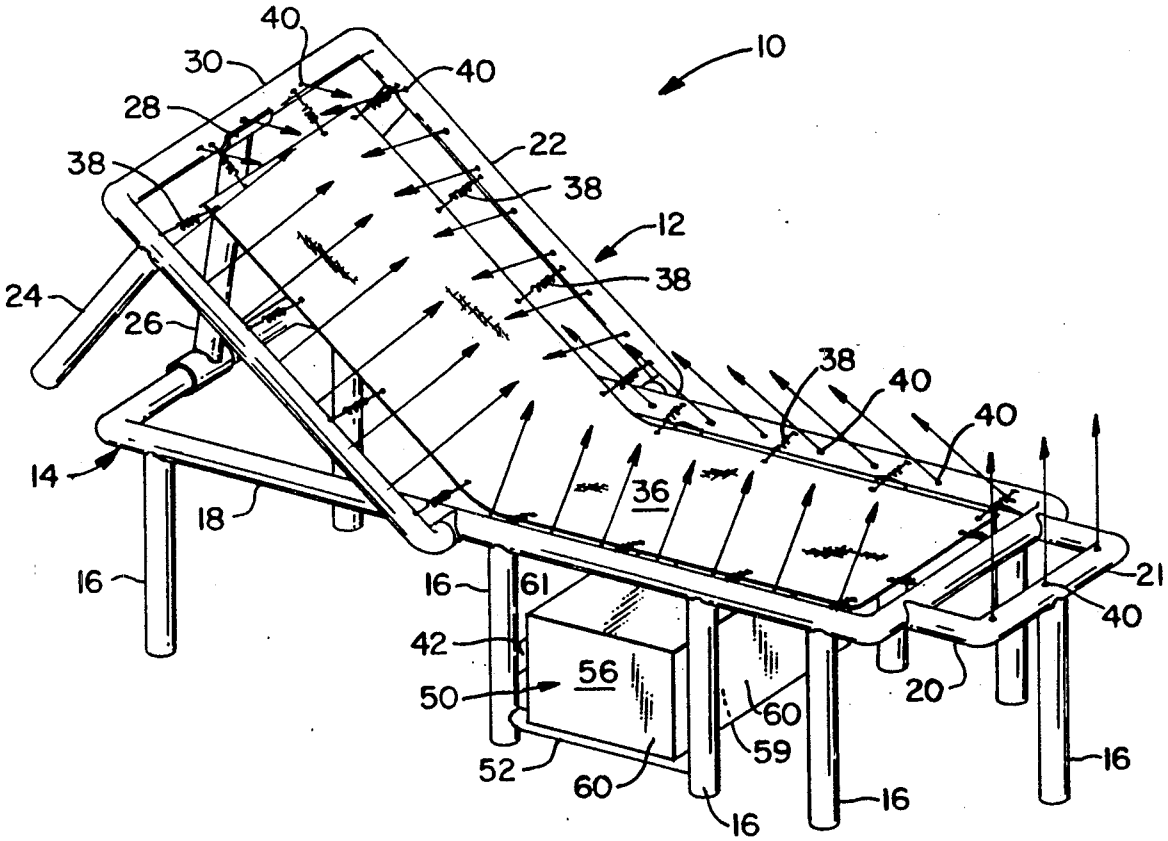
FIG. 2 is an isometric view of a chaise lounge incorporating a second embodiment of an air jet system of the present invention, additionally showing, with arrows, the axes of the air jets of the system.
Figure 1:
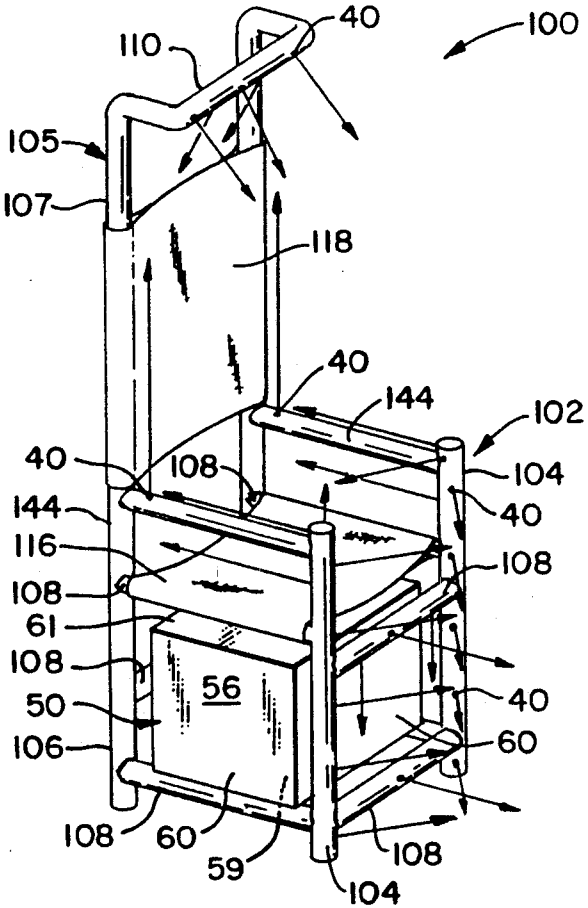
FIG. 1 is an isometric view of an upright chair incorporating a first embodiment of an air jet system of the present invention, additionally showing, with arrows, the axes of the air jets of the system.
Figure 4:
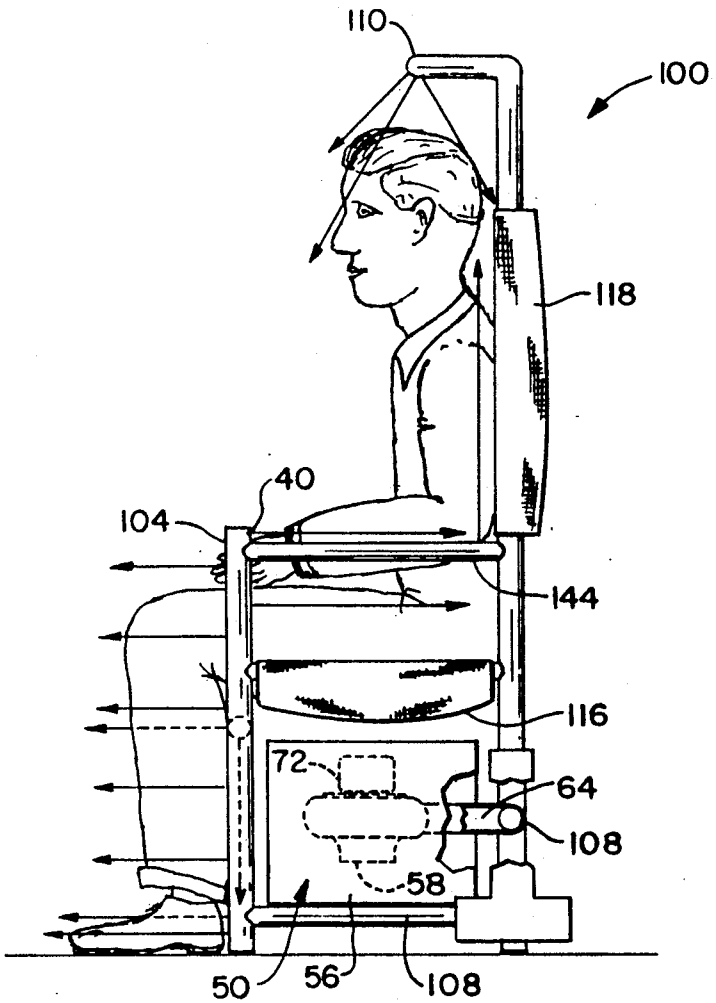
FIGS. 3, 4 and 5 respectively, are enlarged front and side elevation views and top plan view of the upright chair and arrows shown in FIG. 1, additionally showing an occupant sitting in the chair.
Figure 3:
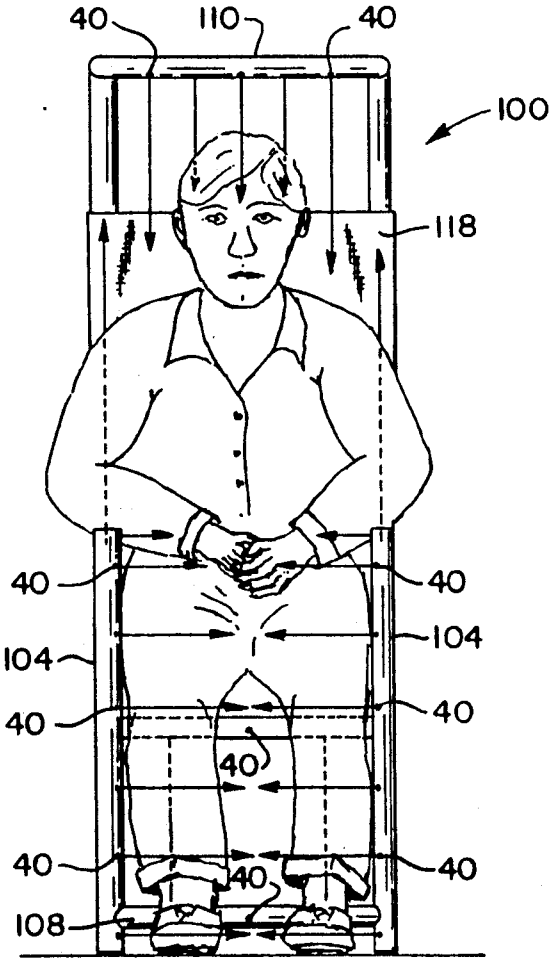
Figure 5:
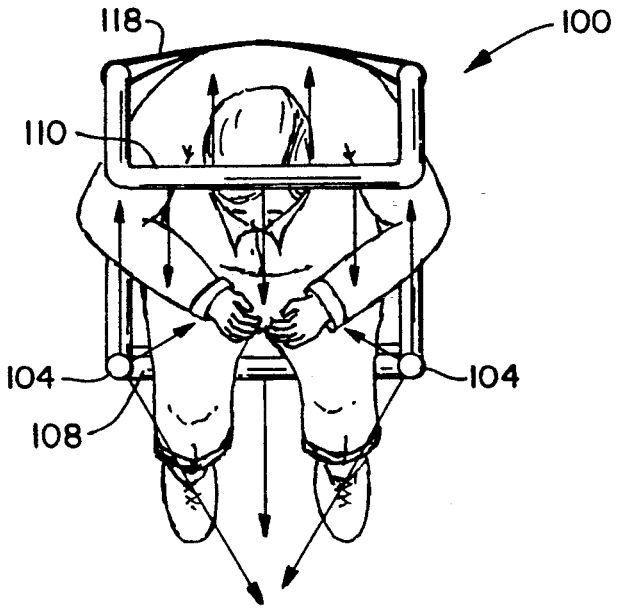
Figure 9:
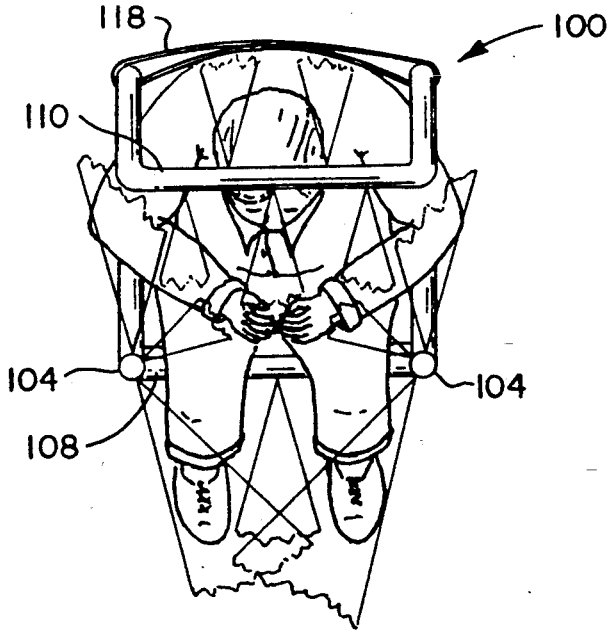
FIGS. 7, 8 and 9 respectively, are enlarged front and side elevation views and top plan view of the upright chair and arrows shown in FIG. 1, additionally showing an occupant sitting in the chair and showing in part an outline of the air jets of the air jet system.
Figure 6:
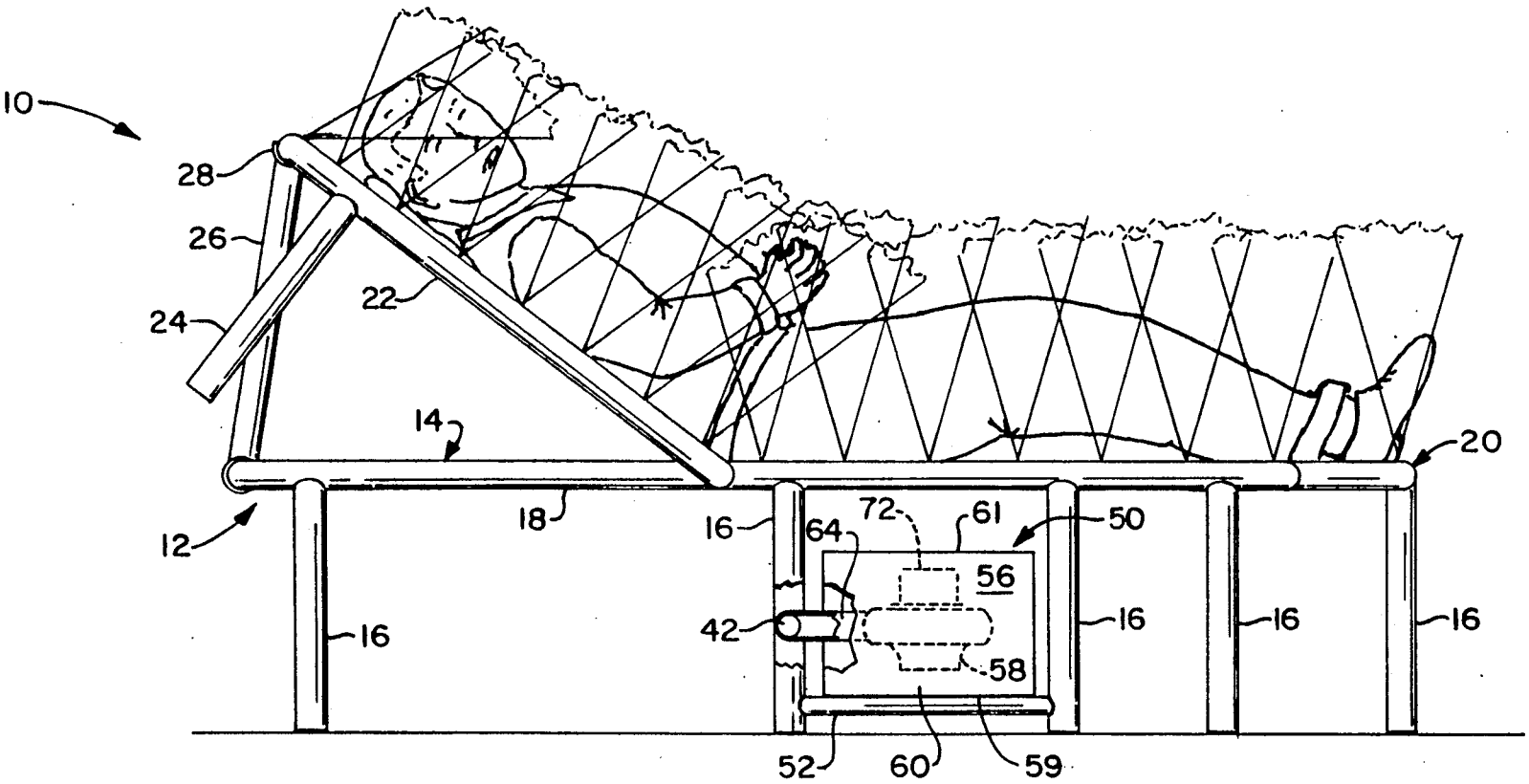
FIG. 6 is an enlarged side elevation view of the chaise lounge and arrows shown in FIG. 2, additionally showing an occupant lying on the chaise lounge and showing in part, an outline of the air jets of the air jet system.
Figure 8:
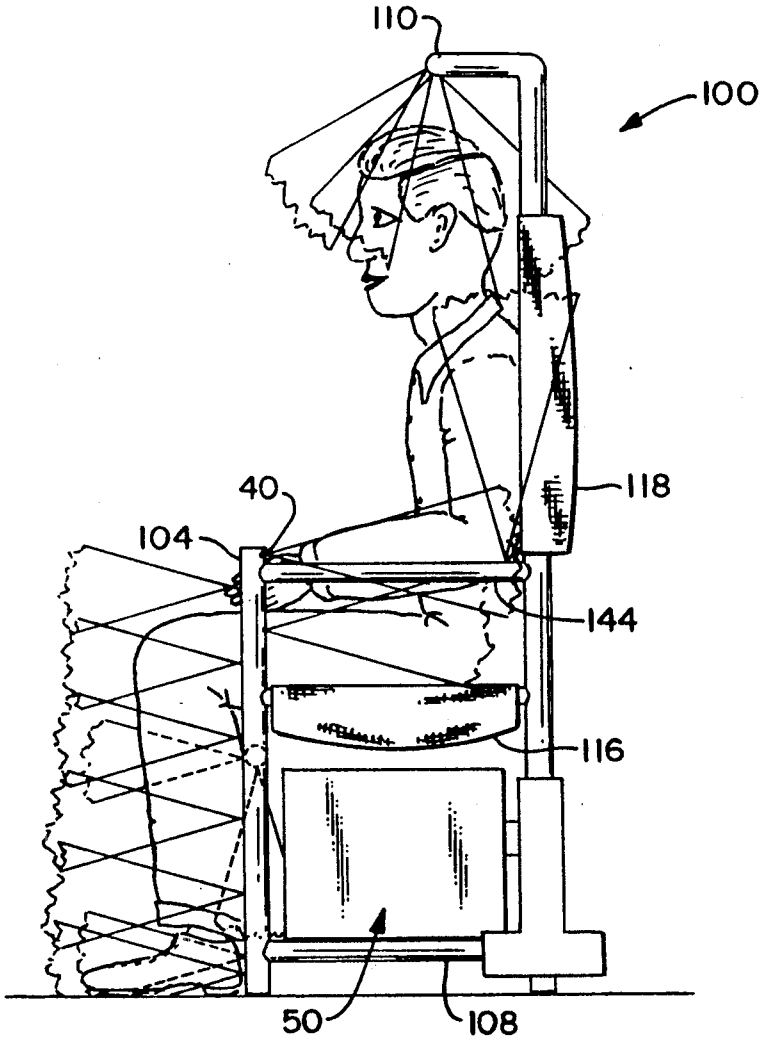
Figure 7:
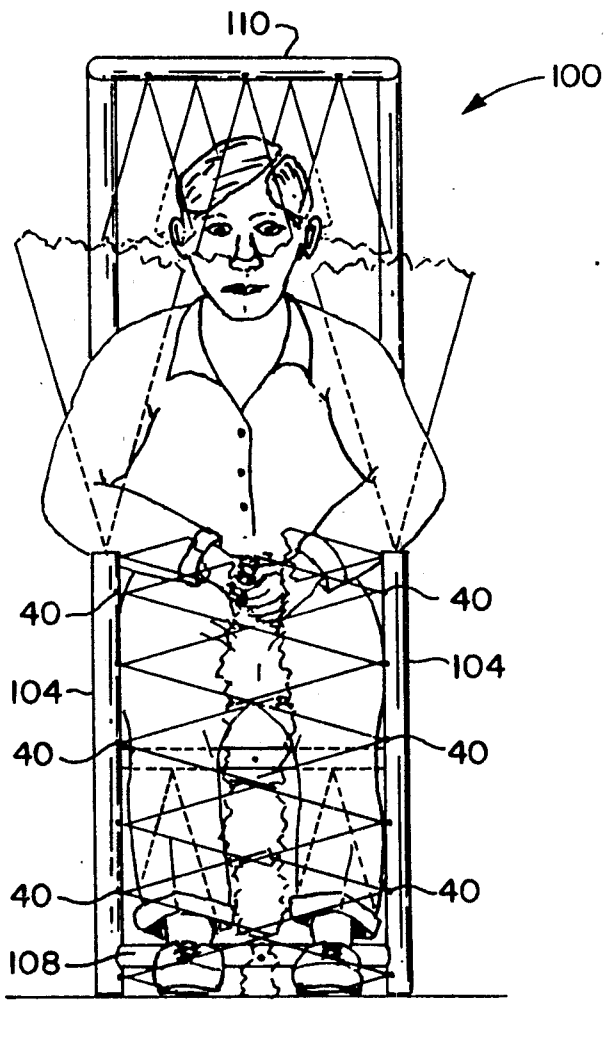

In the drawings, like numerals are employed to identify the same or similar parts. Two outdoor chairs 10, 100 incorporating the present invention are shown in the drawings. The two chairs, a chaise lounge 10 and an upright chair 100, represent two substantially different embodiments of the present invention.

Each chair 10, 100 has a tubular frame 12, 102 of generally conventional construction except as disclosed herein. The frames 12, 102 are shown made of plastic tubing, but may be made of aluminum tubing or other suitable metal tubing. Most of the tubular components of each chair frame have an ID between 1 and 2 inches and a corresponding OD between approximately 1½ and 2½ inches respectively. The preferred diameter of each component is described hereafter.

The tubular frame 102 of the upright chair 100 includes a pair of front upright legs 104 and a pair of rear upright members 105 which form the rear legs 106 of the chair and the side bars of a back frame 107 of the chair. The base of the chair has horizontal crossbars or rungs 108 extending between the legs of the chair at the front, rear and both sides of the chair. A forwardly offset head bar 110 is provided at the top of the back frame 107, preferably so that it is about 4 to 8 inches above the head of an occupant depending upon the sitting height of the occupant. The head bar 110 is located forwardly of the remainder of the back frame 107 so that it is centrally positioned over the head of the occupant (as shown in the drawings). In the alternative, the head bar 110 is located directly over or slightly in front of the face of the occupant. All of the components of the upright chair frame 102 are securely joined together to provide a rigid and sturdy assembly.

In the chaise lounge 10, a flat elongated base frame 14 is supported in a horizontal position by a plurality of short vertical legs 16. The base frame includes a primary rectangular frame 18 and a short, U-shaped foot section 20 having an opening for receiving the feet of an occupant. A flat elongated head frame 22 is mounted on the two parallel side bars of the base frame 14 for pivotal movement about a transverse axis spaced from the center of the base frame toward the head of the base frame. The pivotal head frame 22 has a pair of support legs 24 for supporting the head frame 22 in a generally horizontal position. The head frame 22 can also be supported in a raised or inclined position by a pivotal arm 26 having an arcuate saddle 28 for receiving the head bar 30 of the pivotal head frame 22. Except for the pivotal support arm 26 and the two pivotal connections between the generally U-shaped head frame 22 and base frame 14, all of the components of the frame 12 are securely joined together to provide a rigid and sturdy assembly.

In a conventional manner, each chair includes a suitable occupant support of canvas or other fabric or material. In the upright chair 100, a fabric seat 116 is provided between two parallel side rungs 108 and a fabric back 118 is provided between the two side bars of the back frame 107. In the chaise lounge 10, a rectangular fabric support bed 36 is resiliently mounted by tension springs 38 within an elongated opening in the head and base frames 14, 22. The fabric used for the seat 116 and back 118 of the upright chair 100 and bed 36 of the chaise lounge 10 preferably has a sufficient weight or tightness of weave to prevent mosquito bites and other insect bites through the fabric.

A relatively large air plenum is provided within the frame of each chair 10, 100 for supplying air under pressure to a plurality of air nozzles 40 specially arranged around the frame as hereafter described. In the chairs 10, 100, the nozzles 40 are provided in the tubular structural components of the frame. In the alternative, the nozzles may be provided by additional, non-structural components of the frame.

In the chaise lounge 10, a primary air plenum is provided by the internal openings within the tubular components of the pivotal head frame 22 and fixed base frame 14. The two pivotal connections between the head and base frames have large internal air passages (preferably having an ID of at least 1 inch) for connecting the internal passageways within those two frames. The internal openings within the two middle legs 16 of the base frame 14 and a crossbar 42 extending between those legs 16 form part of and are connected to the rest of the air plenum. For that reason, the bottom of each of the two middle legs 16 is suitably capped or plugged. The internal openings within any or all of the remaining legs 16, 24 can also form part of and be connected to the rest of the air plenum, in which case their lower ends are also suitably capped or plugged.

In the upright chair 100, the primary air plenum is provided by the internal openings in the front legs 104, head bar 110, arm rests 144 and upper and lower front horizontal rungs 108. The air plenum is also formed in part by the internal openings within the rear legs 106 and the horizontal rung 108 between the rear legs 106. The bottom of each of the four legs 104, 106 is suitably capped or plugged. The internal air plenum is also preferably formed in part by the internal openings within the two horizontal side rungs 108 on each side of the chair (in which event, the air plenum is formed by all of the components of the chair frame).

Each chair 10, 100 has a blower unit 50 securely supported within the base of the chair, above the bottom plane of the chair and between the legs of the chair below the occupant support seat or bed. In the upright chair 100, the blower unit 50 is mounted generally centrally below the seat 116 on the two lower side rungs 108. In the chaise lounge 10, the blower unit 50 is similarly mounted on two lower side rungs 52 extending from the two middle legs 16 toward the foot of the chair to adjacent legs 16. Each blower unit 50 has a box-like housing or enclosure 56 with suitable air inlet openings in the bottom and/or one or more of the four sidewalls of the housing. Each blower unit 50 has an internal blower 58, preferably a centrifugal fan having a vertical axial inlet for drawing air upwardly from inside the housing. In the chaise lounge 10, air inlet openings are preferably provided in the bottom 59 of the housing 56 and/or in the housing sidewall 60 facing the foot of the chair. In the upright chair 100, air inlet openings are preferably provided in the bottom 59 and/or front sidewall 60 of the housing 56.

The outlet 64 of the blower 58 is directly connected to the chair frame 12, 102 to supply air under pressure to the air plenum within the frame. In the chaise lounge 10, the blower outlet 64 is connected to the lower crossbar 42 to supply air to approximately the center of the base frame 14 and substantially equally to the two sides of the chair. In the upright chair 100, the blower outlet 64 is connected to the rear crossbar 108 to supply air evenly to the two sides of the chair. In each chair 10, 100, the blower 58 has a volumetric capacity (according to the chair configuration and the number and size of air nozzles 40) for maintaining an appropriate air pressure within the primary air plenum of the chair. For example, the blower provides a steady state air pressure throughout the primary air plenum of approximately 0.02 psi (or 0.5625 inches of water).

The blower 58 is preferably driven by a suitable electric motor 72 adapted to be connected to a standard 120 volt AC outlet (by a short or long electrical cord as needed). In the alternative, a small gasoline engine (not shown) may be employed to drive the blower 58. In either case, suitable sound dampening material is provided on the inside of the bottom 59, top 61 and four sidewalls 60 of the housing 56 (except where the air inlet openings are provided) to reduce the sound generated by the blower unit 50 to an acceptable level. Also, the blower 58 and its drive motor 72 or engine are supported by suitable resilient mounts (not shown) within the housing 56 to prevent the transmission of vibration to the chair frame 12, 102.

The frame components forming the upstream sections of the air plenum of each chair frame 12, 102 are preferably made of larger diameter tubing (e.g., having an ID of 2 inches) to reduce the pressure loss between the blower outlet 64 and air nozzles 40. In the upright chair 100, the rear crossbar 108 connected to the blower outlet 64 and the two rear legs 106 are preferably made of the larger diameter tubing. In the chaise lounge 10, the crossbar 42 connected to the blower outlet 64 and the two middle legs 16 are preferably made of the larger diameter tubing. The components of the primary air plenum of each chair frame are preferably made of tubing having a 1 inch ID. The remaining components of each chair frame are preferably made of tubing having a 1 inch OD.

Each chair 10, 100 has a large number of air nozzles 40 which are specially located around the primary air plenum of the chair for producing air streams in specific directions in relationship to an occupant sitting or lying in the chair in a predetermined normal position (shown in the drawings). The primary air plenum of each chair is oriented in relation to the normal position of the occupant for that purpose. Each nozzle 40 is provided by a drilled hole having an axis perpendicular to the axis of the frame component into which it is drilled. Each nozzle 40 produces a generally conical stream or jet of turbulent air coaxial with the nozzle 40. In each chair, each nozzle 40 is located to cooperate with the other nozzles 40 to produce air stream barriers for protecting the occupant of the chair against mosquitoes and other flying insects. More particularly, the nozzles 40 are located and arranged so that the air jets produce air stream barriers which partly or totally cover or envelop an occupant to protect the occupant against mosquitoes. The air stream barriers provide a cover or envelope over the body and entirely around certain parts of the body to protect those parts against mosquitoes and other flying insects. Also, the air stream barriers provide for bathing certain normally exposed areas of the body with turbulent air having a relatively low velocity of approximately 2–3 mph. Each nozzle is sized according to its location and the steady state air pressure at the nozzle inlet. With an inlet pressure of approximately 0.02 psi, ¼ inch and ½ inch diameter nozzles have been found to be appropriate.

In the chaise lounge 10, ½ inch diameter nozzles 40 are provided in the head bar 30, in the parallel side bars of the pivotal head frame 22 and in the parallel side bars of the base frame 14 between the pivot axis of the head frame 22 and the foot section 20 of the base frame 14. The nozzles 40 are preferably spaced approximately 4 inches apart along the full length of those sections of the frame 12. Those air nozzles 40 are angularly oriented so that their axes point inwardly and upwardly at an angle less than 60 degrees and preferably at approximately 40–50 degrees to the plane of the respective frame 14, 22. The nozzles 40 in the side bars of the head frame 22 form two parallel rows or banks of opposed nozzles lying in a common transverse plane and on opposite sides of a chair occupant. Likewise, the nozzles 40 on the side bars of the base frame 14 form two parallel rows or banks of opposed nozzles lying in a common transverse plane and on opposite sides of a chair occupant. Those four rows of side nozzles 40 are inclined so that the air jets or air streams produced by those nozzles 40 intersect within a zone of intersection at approximately a vertical centerline plane of the chair and over an occupant lying on the bed 36 of the chair. The nozzles 40 in the head bar 30 are inclined inwardly and upwardly to produce air stream barriers which intersect the air stream barriers from the side nozzles 40 within a transverse zone of intersection.

A ¼ inch nozzle 40 is provided at the center and at each end of a foot bar 21 of the foot section 20 to produce air stream barriers between and on the outside of the feet of the occupant. The axes of those nozzles 40 are approximately vertical or inclined no more than approximately 10 degrees from the vertical, to produce air stream barriers which substantially envelop the occupant's ankles and feet.

In the upright chair 100, nozzles 40 are provided in the head bar 110, front legs 104, arm rests 144 and the two front horizontal rungs 108. Five ½ inch nozzles 40 are spaced approximately 4 inches apart along the head bar 110. The outer two nozzles 40 point downwardly and forwardly at an angle of approximately 45 degrees to a horizontal plane to produce air stream barriers at the sides of the head and neck of the occupant. The center nozzle 40 points downwardly and forwardly at an angle of approximately 30 degrees to a horizontal plane to produce an air stream barrier over the head and in front of the face of the occupant. Two intermediate nozzles 40 (between the center and outer nozzles) point downwardly and rearwardly at an angle of approximately 60 degrees to a horizontal plane to produce air stream barriers for protecting the back of the head and neck of the occupant.

A ½ inch diameter nozzle 40 is provided at the rear end of each arm rest 144. The axis of each of those nozzles 40 is preferably approximately vertical so that those nozzles produce air stream barriers for protecting the sides and upper arms of the occupant. These air streams preferably meet the air streams from the end nozzles 40 on the head bar 110 to envelop or cover the sides of the occupant between the arm rest 144 and head bar 110. A rearwardly pointing ½ inch nozzle 40 is provided at the top of each front leg 104 (above the arm rest 144) to produce an air stream barrier which protects and partially envelops the respective forearm and hand of the occupant. These air stream barriers cooperate with the air stream barriers produced by the vertical nozzles 40 at the rear end of the arm rests 144 to produce air stream barriers along the sides of the occupant above the arm rests 144. A second, rearwardly pointing, ½ inch nozzle 40 is provided on each front leg about 4 inches below the respective arm rest 144 for producing an air stream barrier along the side of the occupant below the arm rest 144. These side barriers extend to the back of the chair to protect the upper legs and hips of the occupant. A ¼ inch nozzle 40 is provided at the top of each front leg 104, pointing inwardly and rearwardly at an angle of approximately 30 degrees to a transverse vertical plane. These nozzles 40 produce air streams which meet within a zone of intersection at approximately a vertical centerline plane of the chair in front of the occupant to protect and envelop the lap area of the occupant. Five ½ inch nozzles 40 are spaced approximately 4 inches apart along the front of each front leg 104. These leg nozzles 40 form two parallel rows or banks of opposed nozzles in a common transverse plane and on opposite sides of a chair occupant. These nozzles 40 point laterally inwardly and forwardly at an angle of approximately 60–80 degrees to a transverse vertical plane. The multiple air streams from the two front legs meet in front of the occupant within a zone of intersection at approximately the centerline plane of the chair to fully envelop or cover the front of the occupant to protect the lower legs, ankles and feet of the occupant. One ¼ inch, forwardly pointing nozzle 40 is provided at the center of each front rung 108 to produce air stream barriers between the legs of the occupant to protect and envelop the inner side of the occupant's legs. Two outer ¼ inch nozzles 40 are provided in the upper front rung 108. These nozzles 40 point downwardly to produce air stream barriers along the back of the legs, ankles and feet of the occupant.

Thus, in each chair 10, 100, air stream barriers are produced which substantially completely envelop the occupant from above the head of the occupant to the foot of the occupant. Because of the generally conical shape of the air jets, the normally exposed areas of an occupant including the occupant's head, neck, chest, upper arms, forearms, hands, knees, lower legs, ankles and feet are bathed by low velocity air. It has been found that mosquitoes will not fly into turbulent air having a velocity greater than 2–3 miles per hour. Thus, the air stream barriers preferably have a minimum velocity of approximately 2–3 mph at or above the body surface. The velocity at the nozzle outlets is preferably approximately 5–6 mph to achieve the desired minimum velocity along the body surface. It is believed that mosquitoes and other flying insects are repelled because of the velocity of the turbulent air and the insect awareness of the turbulent air from the low amplitude, hissing sound produced by the turbulent air.

As will be apparent to persons skilled in the art, various modifications, adaptations and variations of the foregoing specific disclosure can be made without departing from the teachings of the present invention.

I claim:

1. A chair having a frame, an occupant support mounted on the frame for supporting an occupant in a predetermined normal position relative to the frame, the frame having a plurality of tubular components providing an internal air plenum, and a blower unit connected to supply air under pressure to the air plenum, the air plenum comprising a primary air plenum with a predetermined orientation with respect to a said occupant, the tubular components forming the primary air plenum having an arrangement of a plurality of air nozzles pointing in specific directions in relationship to a said occupant to produce air stream barriers which cover and bathe certain, normally exposed, areas of a said occupant, including the lower legs and ankles of a said occupant, to protect said areas against mosquitoes and other flying insects, the arrangement of air nozzles including tow sets of air nozzles, on opposite sides of a said occupant, pointing laterally inwardly to produce air stream barriers which intersect within a zone of intersection spaced outwardly from the chair to protect certain areas of a said occupant between the two sets of nozzles.

2. A chair according to claim 1 wherein said air nozzles point in specific directions in relationship to a said occupant to produce air stream barriers which cover most of the body of a said occupant from head to feet.

3. A chair according to claim 1 wherein said two sets of air nozzles includes two opposed rows of air nozzles, on opposite sides of a said occupant, pointing laterally inwardly to produce air stream barriers which intersect at approximately a vertical centerline plane of the chair within a zone of intersection spaced outwardly from the chair to protect certain areas of a said occupant between the two rows of nozzles.

4. A chair according to claim 3 wherein the nozzles of the two rows of nozzles generally lie in a common plane and point laterally inwardly at an acute angle less than 60 degrees to said common plane.

5. A chair according to claim 3 wherein the nozzles of the two rows of nozzles generally lie in a common plane and point laterally inwardly at an acute angle of approximately 60–80 degrees to said common plane.

6. A chair according to claim 1 wherein the nozzles produce air streams having a nozzle outlet velocity of approximately 5–6 miles per hour.

7. An upright chair having a frame, an occupant support seat and back mounted on the frame for supporting an occupant in a predetermined normal upright sitting position relative to the frame, the frame having a plurality of tubular components providing an internal air plenum, and a blower unit connected to supply air under pressure to the internal plenum, the air plenum comprising a primary air plenum with a predetermined orientation with respect to a said occupant, the tubular components forming the primary air plenum comprising a pair of front upright legs, front rung means extending between the front legs, and upper bar means adjacent the head of a said occupant, said front legs, upper bar means and rung means having an arrangement of a plurality of air nozzles pointing in specific directions in relationship to a said occupant to produce air stream barriers which cover and bathe certain, normally exposed, areas of a said occupant, including the lower legs and ankles of a said occupant, to protect those areas against mosquitoes and other flying insects, the arrangement of air nozzles including two sets of air nozzles, on opposite sides of a said occupant, pointing laterally inwardly to produce air stream barriers which intersect within a zone of intersection spaced outwardly from the chair to protect certain areas of a said occupant between the two sets of nozzles.

8. An upright chair according to claim 7 wherein said two sets of air nozzles include two opposed rows of air nozzles, on the front legs on opposite sides of a said occupant, pointing laterally inwardly to produce air stream barriers which intersect at approximately a vertical centerline plane of the chair within a zone of intersection spaced outwardly from the chair to produce air stream barriers which protect certain areas of the legs of a said occupant between the two rows of nozzles.

9. An upright chair according to claim 8 wherein the nozzles of the two rows of nozzles generally lie in a common transverse plane and point laterally inwardly at an acute angle of approximately 60–80 degrees to said common plane.

10. An upright chair according to claim 7 wherein the upper bar means comprises a generally horizontal head bar with outer nozzles pointing generally downwardly to produce air stream barriers on both sides of the head of a said occupant.

11. An upright chair according to claim 10 wherein the upper bar means has a plurality of nozzles between said outer nozzles pointing downwardly and outwardly to produce air stream barriers in front and back of the head of a said occupant.

12. An upright chair according to claim 7 wherein said arrangement of air nozzles includes rearwardly pointing nozzles on the front legs to produce air stream barriers along the sides of a said occupant.

13. An upright chair according to claim 7 wherein the tubular components forming the primary air plenum comprises a pair of arm rests, each having at least one air nozzle pointing upwardly to produce an air stream barrier along the respective side of a said occupant.

14. An upright chair according to claim 7 wherein said arrangement of air nozzles includes inwardly and rearwardly pointing nozzles on the front legs to produce air stream barriers which cover the lap of a said occupant.

15. An upright chair according to claim 7 wherein said arrangement of air nozzles includes air nozzles on the front rung means pointing generally horizontally outwardly to produce air stream barriers between the legs of a said occupant and pointing generally downwardly to produce air stream barriers on the back of the legs of a said occupant.

16. A chaise lounge having a frame, an occupant support bed mounted on the frame for supporting an occupant in a predetermined normal lying position relative to the frame, the frame having a plurality of tubular components providing an internal air plenum, and a blower unit connected to supply air under pressure to the internal air plenum, the air plenum comprising a primary air plenum with a predetermined orientation with respect to a said occupant, the tubular components forming the primary air plenum comprising a base frame with two side bars and a head frame with two side bars, pivotally mounted on the side bars of the base frame, the side bars of the head frame and base frame each having a plurality of air nozzles pointing laterally inwardly to collectively produce air stream barriers which intersect at approximately a vertical centerline plane of the chair within a zone of intersection above the support bed to protect certain areas of a said occupant along approximately the full length of the side bars.

17. A chaise lounge according to claim 16 wherein the base frame has a foot section, at the foot of the base frame, having a plurality of air nozzles for producing air stream barriers to protect the feet of a said occupant.

18. A chaise lounge according to claim 17 wherein the foot section has a foot bar with a plurality of air nozzles pointing generally upwardly for producing air stream barriers between and on the outside of the feet of a said occupant.

19. A chaise lounge according to claim 16 wherein the air nozzles on the side bars of the base frame form two opposed rows of air nozzles generally lying in a common plane and pointing laterally inwardly at an acute angle less than 60 degrees to said common plane.

20. A chaise lounge according to claim 16 wherein the air nozzles on the side bars of the head frame form two opposed rows of air nozzles generally lying in a common plane and pointing laterally inwardly at an acute angle less than 60 degrees to said common plane.

21. A chaise lounge according to claim 16 wherein the head frame comprises a lateral head bar having a plurality of air nozzles pointing upwardly and inwardly to produce air stream barriers which intersect the air stream barrier from the side bar nozzles on the side bars of the head frame.

* * * * *